United States Patent [19]

Okachi et al.

[11] Patent Number: 4,787,282

[45] Date of Patent: Nov. 29, 1988

[54] METHOD AND APPARATUS FOR FORMING BY PUNCHING

[75] Inventors: Kenji Okachi; Sadaharu Ishihara, both of Inuyama, Japan

[73] Assignee: The Warner & Swasey Company, Cleveland, Ohio

[21] Appl. No.: 80,935

[22] Filed: Aug. 3, 1987

[30] Foreign Application Priority Data

Aug. 9, 1986 [JP] Japan ..... 61-187540

[51] Int. Cl.[4] ..... B26V 3/00

[52] U.S. Cl. ..... 83/25; 83/27; 83/49; 83/103; 83/157; 83/256; 83/358; 83/365; 83/405; 83/552

[58] Field of Search ..... 83/23, 25, 27, 49, 103, 83/104, 157, 256, 358, 365, 405, 552

[56] References Cited

U.S. PATENT DOCUMENTS

| | | | |
|---|---|---|---|
| 2,167,734 | 8/1939 | Zonino | 83/103 X |
| 3,185,006 | 5/1965 | Mercer et al. | 83/358 X |
| 3,383,065 | 5/1968 | Bergeron et al. | 83/143 X |
| 3,513,625 | 5/1970 | Eller et al. | 83/365 X |
| 3,878,745 | 4/1975 | Handziak et al. | 83/61 |
| 4,507,995 | 4/1985 | Bredow | 83/153 |
| 4,546,683 | 10/1985 | Volkel et al. | 83/27 |
| 4,690,021 | 9/1987 | Clark | 83/71 |

*Primary Examiner*—Frank T. Yost
*Assistant Examiner*—Eugenia A. Jones
*Attorney, Agent, or Firm*—John R. Benefiel; Raymond J. Eifler

[57] ABSTRACT

A method and apparatus for forming planar parts (WA) by progressively punching out the shape of the part (WA) from a piece of sheet material (W) in which the part (WA) is automatically removed from the remaining sheet material (W), by a hinged trap door section (37) in a work supporting table (33), one end lowered to form a chute. The punching process is carried out primarily in a first punching station (A), where punch and die set magazines (18, 19) may be mounted, but connecting sections (WC) are left to be removed in a second punching station (B) where the trap door section (37) is located. The separated parts (WC) are deposited on a conveyor system (36) located beneath the table 33, and detector unit (59, 61) enables shut down of the press if a part fails to move after each punching operation.

9 Claims, 4 Drawing Sheets

METHOD AND APPARATUS FOR FORMING BY PUNCHING

FIELD OF THE INVENTION

The present invention relates to a method of automatic forming of shapes by progressive punching of a work sheet, and the apparatus used therefor.

BACKGROUND OF THE INVENTION

A punch press system is often used to progressively form shapes out of sheets of metal and other material.

In this application the punch press system combines punching devices, each composed of a punch and a die set, and a material transfer table which permits arbitrary positioning of a work sheet. Punching is performed automatically at high speed in successive positions of the work sheet. By making each successive punching step immediately adjacent to the position of the hole formed by the prior punching step and repeating this operation, a band shaped, continuous hole is produced. By utilizing this process, a punched-out form of arbitrary shape may be obtained.

Cutting out an arbitrary shape from a work sheet has been done using a laser cutting and this method has achieved remarkable development in recent years, but the method of punching out desired shapes as above described using a punch-press is still far quicker.

In the above progressive punching method, the punched-out form obtained by punching the work sheet in the desired profile was separated from the work sheet at the punching station, making it difficult to remove the punched out form from within the remainder of the sheet; and this was thus often done manually, with the attendant hazard to the operator and interruption to the punching process. Alternately, this could be accomplished by stopping the punching operation, moving the whole of the work sheet to the operator's side by operation of the work transfer table, whereby the punched-out form, being loose inside the punched profile hole, was able to be manually but safely removed by the operator. This approach however slows the process considerably.

There has not heretofore been provided a transporting device for removing the work from the punching station due to the great variety of work shapes which may be encountered, the need for dies to be fixed below the work and the use of a great variety of die shapes loaded into turrets or magazines located at the punching station.

The present invention provides a method and apparatus for progressive forming by punching which enables complete automation including automatic handling of the punched out port after completion of the punching operation.

SUMMARY OF THE INVENTION

The method and apparatus for forming by punching according to the present invention solves the aforementioned problem by partially carrying out the punching operations at two different positions of the work sheet, by means of separate sets of punches and dies located at separate first and second punching stations, and a material transfer table device for moving a work sheet between the punching stations. The profile of the particular shape desired is formed from the work sheet by successively punching along the profile, but leaving narrow connections at the first punching station. Subsequently, the punched-out profile is brought to the second punching station by driving the material transfer table device, where the aforementioned remaining connections are punched out. A transfer table device separates the punched-out form from the remainder of the work sheet and a conveyor transports the same out of the machine.

The transfer table device comprises a hinged trap door table section, which when lowered, forms a chute device for dropping the punched-out form onto the conveyor located under the table.

DETAILED DESCRIPTION

Figure 1:
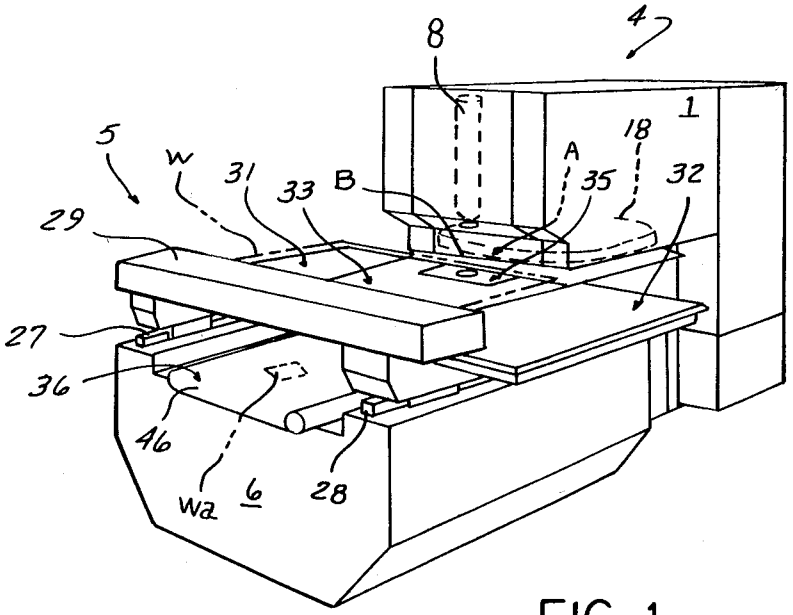
FIG. 1 is a perspective view of a punch press of this invention.

In the following, an embodiment of this invention, as applied to a turret type punch press, is described in reference to the accompanying drawings:

FIG. 1 is a perspective view of a turret type punch press of this embodiment, which is composed of a C-frame (1) with two sets of punching devices (2,3) (FIG. 2) located at first and second punching stations, (A,B) (FIGS. 1, 2, 3) later described in detail, and a material transfer table device (5) which brings the desired portions of the work sheet (W) to and from the aforementioned punching devices. A trapezoidal base frame (6) comprises a support for the material transfer table device (5).

The two sets of punching devices are installed on the upper member of C-frame (1), and are respectively composed of punch drives dismounted on the upper part of the frame (1) and die side units (9), (10) provided on the lower part thereof (FIG. 2), and designed to subject the work sheet (W) brought between punch tools (11), (12).

Figure 2:
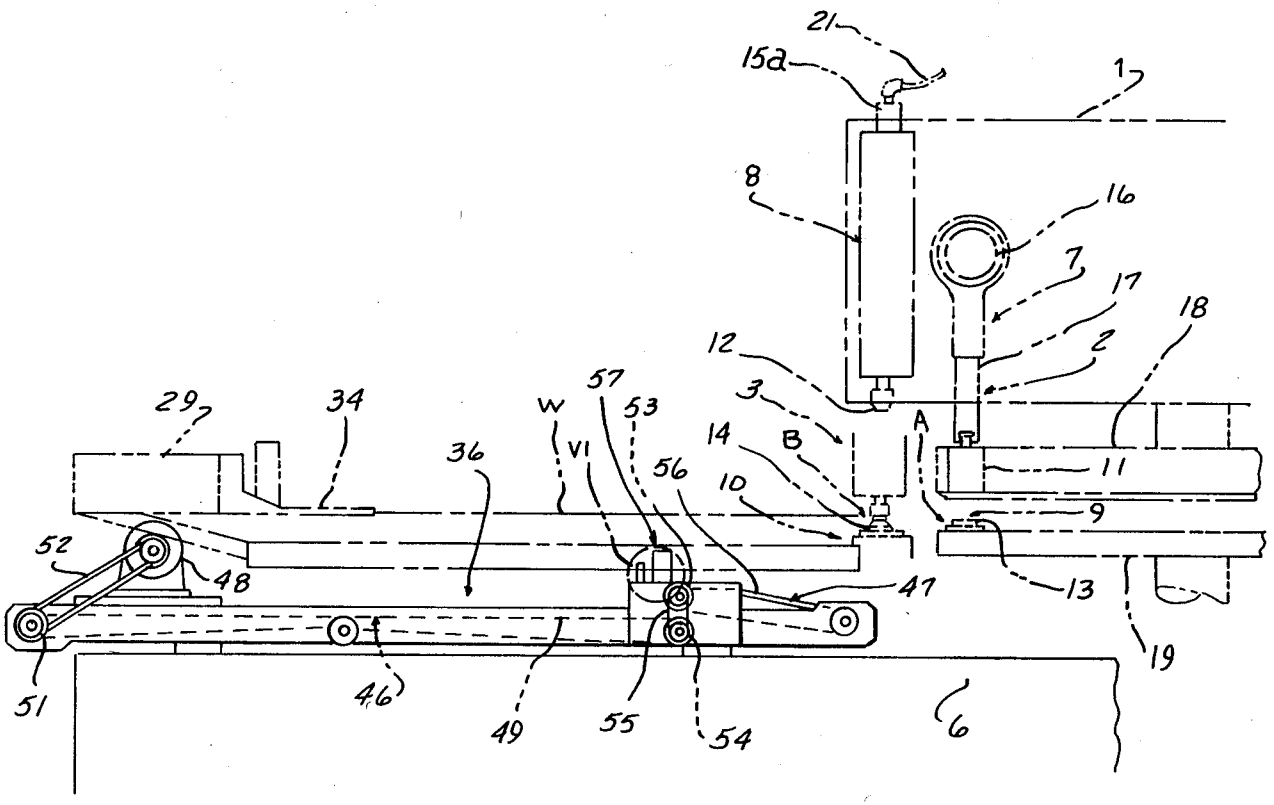
FIG. 2 is a side view of the belt conveyor unit part with fragmentary adjacent portions of the punch press shown in phantom.

The punch drive (8), as shown in FIG. 2, is composed of a hydraulic cylinder (15) arranged on the frame's forward side. Punch drive (7) is composed of an up-down motion ram (17) coupled to a crank shaft (16) on the frame's rear side. The corresponding die assemblies, (9), (10) are placed in coincided positions beneath punch tools (11), (12) respctively to the aforementioned drives (7), (8). In the well-known turret punch press construction of this embodiment there are available large numbers of punches and dies to brought to working station (A), by means of upper and lower turret wheels (18), (19), any selected tool brought to the punching station (A) by the turning of said turret wheels (18), (19).

Figure 5:
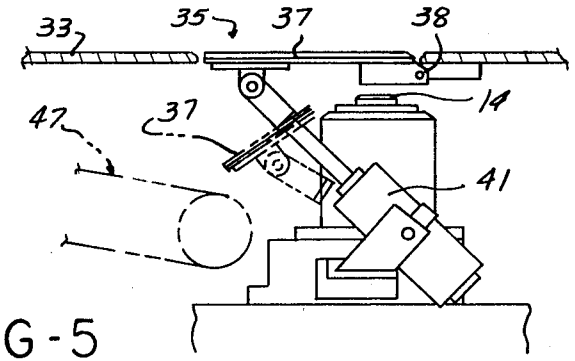
FIG. 5 is a fragmentary partly sectional side view of the components adjacent the second punching station.
Figure 7:
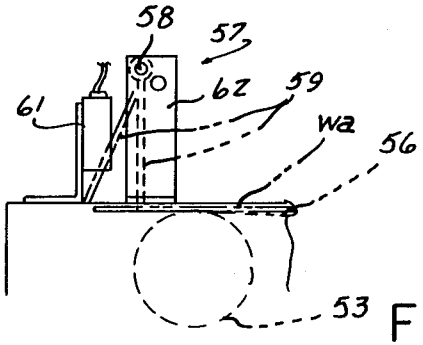
FIG. 7 is a front view of the detection device and adjacent structure shown in FIG. 6.
Figure 7:
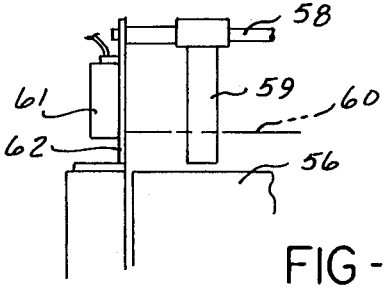

In the aforementioned hydraulic cylinder (15), the cylinder rod (15*a*) side is fixed on the frame (1) and when oil pressure is supplied through a piping (21), the cylinder column (15*b*) side moves downward; the punch tool (12) fixed to the bottom of said cylinder column (15*b*) moving downward therewith (FIG. 5).

Figure 4:
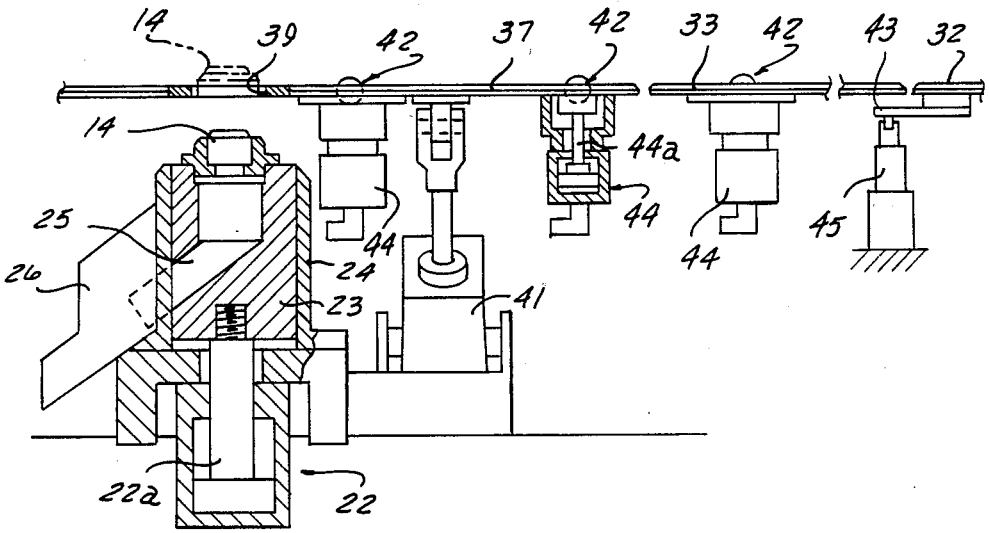
FIG. 4 is a fragmentary partly sectional front view of the components adjacent the second punching station.

In the die assembly (10), as detail in FIG. 4, the die (14) is fixed to a member (23) coupled to cylinder rod (22*a*) of hydraulic cylinder (22) and by the operation of the hydraulic cylinder (22), the die (14) is moved up between a lower position and an upper position indicated in phantom where it appears above a fixed table (33). A guide cylinder (24) is provided for the aforementioned member (23).

Also shown in FIG. 4, is a discharge chute (25) for punched-out slugs, chute (25) extending rearward (in FIG. 4, it is shown as extending leftward for expedience) through the inside of the aforementioned member (23); the punched-out pieces discharge through said discharge chute (25) join the punched-out pieces from the rear punching device (2) in external fixed chute (26) to be discharged into a slug receiving box (not shown in the drawings).

Referring again to FIG. 1, the material transfer table device (5) is composed of a carriage (29) which moves on rails fixed on the base frame and extending in the fore and aft direction. Right and left transfer tables (31), (32), are mounted to the carriage (29), while a stationary table (33) is fixed on the base frame (6) at an intermediate position between transfer tables (31), (32) at an even level. Work holders (34) (FIGS. 2 and 3) are driven to move side to side on the aforementioned carriage (29) to provide movement of a work sheet along either rectilinear axis in the plane of tables (31), (32), (33). The right and left tables (31), (32) and the movement of the aforementioned carriage (29) and tables (31), (32) and the side to side movement of the work holders (34) relative to the carriage (29) may be accomplished by ball screws and ball nuts and the turning of servomotors coupled to the ball screws (not shown).

According to the present invention, a chute means (35) later is located the second punching station (B), as well as a belt conveyor device (36) extending therefrom, both located at the center on the base frame (6).

Figure 3:
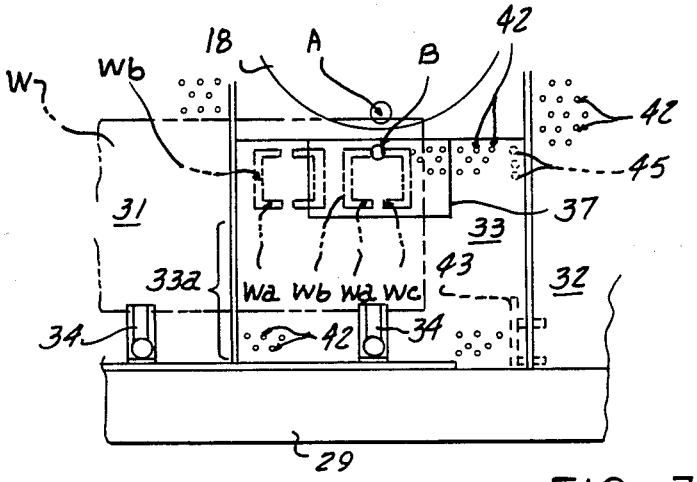
FIG. 3 is a fragmentary plan view of the material transfer table device.

As shown in FIGS. 3, 4 and 5, a trap door (37) is installed in the stationary table (33) at the second punching station (B) hinged at (38) to enable downward movement of, whereby a chute is provided for the shaped part (WA) punched from the work sheet (W).

A hole (39) in table 33 allows the die (14) at the punching station (B) to move up above the table.

A cylinder (41) is provided for opening and closing the trap door (37). Idler balls (42) are mounted in a large number throughout the surface of tables (31), (32), (33) including the trap door (37) as shown to provide smooth work sheet movement. The idler balls (42) located over the stationary table (33) are designed to be lowered under the table successively with the movement of the carriage (29) by the action of a cam (43) and cylinders (44).

The idler balls (42) are lowered below the surface of the fixed table (33) for avoidance of the bottoms of said work holders (34) impinging on the balls, as the work holders (34) sweep just above the surface of the stationary fixed table (33) with the movement of the carriage (29). Each row of the idler balls (42) on the part (33*a*) of the fixed table (33) forward of the trap door (37), and on the trap door (37) are lowered one row after another by the cam (43) projecting from the aforementioned transfer table (32). Each idler ball (42) is fixed to the rod (42*a*) end of a cylinder (44) (FIG. 4) and the valve change-over switches (45) for switching of the action of the cylinders (44) in each row engaged by the cam (43) projecting from the aforementioned movable table (32). As cam (43) moves past table (33), each row of cylinders (44) is operated by switches (45) for the corresponding valves (not shown) for each row.

Adjacent to the trap door (37), as shown in FIGS. 2 and 5, there is provided a belt conveyor device (36) for conveying out the punched-out forms (Wa), located below the stationary table (33) and mounted on the base frame (6).

Belt conveyor device (36) is, as shown in FIG. 2, composed of a front, relatively long, horizontally held conveyor unit (46), and a rear conveyor unit (47) adjacent to the rear of front conveyor unit (46), the rear conveyor unit (47) relatively short and inclined. The forwrad end of the front unit (46) projects forward of the base frame (6), such that the punched-out forms (Wa) are discharged to fall into a receiving box (not shown). The conveyor unit (47) rear end is located at the opened position of the aforementioned trap door.

A driving motor (48) is coupled through an interlock (52) with a side belt (49) of front conveyor unit (46), suspended and turned by roller (51). Side belt (56) of rear conveyor unit (47) is suspended and turned by a roller (5) coupled through chain (55) with a roller (54) suspending the other end of the front conveyor unit (46). Both conveyor units (46), (47) are synchronously run by the aforementioned driving motor (48).

A punched-out form detection unit (57) is installed in front of the conveyor unit (47) sloped as above-mentioned, to ensure the conveyance of the punched-out form (Wa), thereby preventing trouble from possible misoperation.

Figure 6:
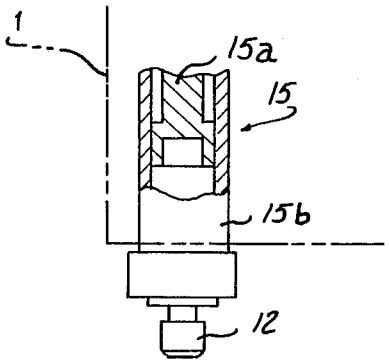
FIG. 6 is a enlarged fragmentary side view of a detection device and adjacent structure depicted in FIG. 2.

A punched-out form (Wa) fed forward to the rear conveyor unit (47) from the trap door (37) is converged to the end of rear conveyor unit (47), then is projected onto the front conveyor unit (46). A large number of detection arms (59) are provided (FIG. 6) suspended from horizontal pivots (58) supported on brackets (62). A photoelectric switch (61) emits light rays (60) across each of the detection arms (59), whereby as the punched-out form (Wa) is projected forward, and the detection arm (59) is swung (FIG. 6), shielding of light rays by said detection arm (59) occurs so that the presence of punched-out form (Wa) may be detected.

If, after the punching operation performed by the punching device (3) at the aforementioned second punching station (B), no punched-out form confirmation signal is obtained, a malfunction (punching unfinished or fall of punched-out form from the chute route or conveying route, etc.) may be indicated and the operation of said punch press is stopped by suitable electrical controls.

The practice of the sheet forming method and the operation of the aforementioned embodiment when producing a rectangular, punched-out form (Wa) as shown in FIG. 3, is as follows.

Initially, the trap door (37) is closed and both hydraulic cylinders (15), (22) are returned to their contracted state. With the appropriate tools (11), (13) on the turrets (18), (19) brought to the first punching station (A), a rectangular profile hole (Wb) is punched out, leaving thin connections (Wc) at from one to several positions.

The number of connections to be left is determined according to the material, thickness of the work sheet and the width of the connection, etc., and should be set at a minimum within the range where the punched-out form (Wa) will not readily come off, even if the work sheet is seized by work holders and moved, so that the time required for punching off the connections (Wc) at the second punching station (B) will be minimized.

After opening the rectangular hole (Wb) as here above-described, the hole (Wb) is brought to the second punching station (B) by operating the material transfer table device (5) and the aforementioned connection (Wc) is positioned and stopped at the second punching station (B) (FIG. 3).

The die assembly (10) is raised by extending the cylinder (22) (shown in phantom in FIG. 4) and then, the cylinder (15) is subsequently extended, to drive the punch tool (12) downward (shown in phantom in FIG. 2) thereby punching off the connection (Wc).

The punched-out scrap pieces released at this time are discharged through the discharge chutes (25), (26) as above-described.

As all connections (Wc) at from one to several positions have been cut off by repeating the aforementioned operation, the punched-out form (Wa) is completely separated from the work sheet (W); therefore, as the trap door (37) is opened, the form (Wa) slides down the inclined trap door (37) (chute), and is delivered to the belt conveyor device (36) under the fixed table (33), and, then, carried to the front of the machine, to be receivedin a suitable box (not shown).

If, however, the aforementioned detection device (57) on the belt conveyor unit (36) has not detected the punched-out form (Wa), the punch press operation itself is brought to an emergency stop, as here above described.

When producing a large number of punched-out forms (Wa) as here above-described, the profile holes (Wb) only may be punched from a cut off of the connections (Wc) only of all the parts, or each part may be produced by the punching of profile hole (Wb) at the first punching station (A) and subsequently the cutting off of the connection (Wc) at the second punching station (B), which successive operations are repeated to produce a completed form (Wa).

The above description clearly shows that the method and apparatus of this invention, complete automated production of the forms (Wa) may be carried out without requiring any manual steps.

We claim:

1. A method of forming a shaped, planar part (Wa) from a sheet of material (W), by moving the sheet (W) past a first punching station (A) along a path defining the shape of said part (WA), repeatedly punching through said sheet (WA) as each portion thereof is presented at said punching station (A) to progressively punch out said part (WA) from said sheet (W), and characterized by the steps of discontinuing said sheet, characterized by the steps of discontinuing said punching and sheet moving process to leave one or more localized bridging connections (Wc) between said sheet (W) and said part (WA), shifting said sheet (W) with said connected part (W) to a second punching station (B) at a different location from said first punching station (A), and punching out said one or more connections (WC) thereat to separate said part (WA) from the remainder of said sheet (W), and removing said part (WA) from said remainder of said sheet (W) at said second punching station (B) by supporting said sheet on the surface of a table (33), providing a hinged trap door within the surface of the table, supporting said part (WA) on said hinged trap door (37) during said punching out of said connections, and lowering one end of said trap door (37) after said one or more connections (WC) are punched out to allow said part (WA) to drop away from said sheet (W) and slide away on said trap door 37.

2. A punch press apparatus (1) for forming planar parts (WA) having a particular peripheral shape from a piece of sheet material (W) including a table transfer system (5) moving said piece of sheet material (W) through a first punching station (A) having a punch assembly (11) and a complementary die assembly (13) in a path corresponding to said shape of said parts (Wa), characterized by a second punching station (B) spaced from said first punching station (A) where at a secondary punching operation is carried out by a second punch assembly (12) and die assembly (14) and punch drive means (7) therefor to complete the formation of the part (Wa), support means including a table (33) located at said second punching station defining a planar surface supporting said sheet material (W) at said second punching station (B) during completion of said punching out of said part (WA); a planar trap door member (37) movably mounted for positioning in a closed or open position, said trap door (37) when in said closed position defining a planar subregion within said surface of said table (33), said subregion directly located beneath said part (WA) in said second punching station (B); mounting means (38) mounting said trap door member (37) to be downwardly movable to said open position to allow said part (WA) to be separated from the remainder of said piece of sheet material (W) by downward movement through an opening in said surface formed by said downward movement of said trap door (37).

3. The punch press according to claim 2 wherein said mounting means (38) includes a hinge (38) for one side of said trap door (37) enabling said trap door (37) to be inclined in being lowered.

4. The punch press according to claim 3 said mounting means further including a power cylinder (41) connected to said trap door member (37) enabling powered up and down movement thereof.

5. The punch press according to claim 4 further including conveyor means (36) receiving parts (Wa) from said lowered trap door member (37) and directing the parts (WA) received out of said punch press (1).

6. The punch press according to claim 5 wherein said conveyor means (36) includes a front conveyor (46) and a rear conveyor (47) said rear conveyor inclined upwardly and receiving said parts (Wa) from said lowered trap door member (37) and carrying said received parts (WA) upwardly to be deposited on said front conveyor (46), and further including detector means (59, 61) detecting the passage of said parts (Wb) from said rear conveyor (47) to said front conveyor (46).

7. The punch press (1) according to claim 2 wherein said punch press (1) includes a frame (1) having an upper and lower spaced apart opposing members, a plurality of punch assemblies (11) and die assemblies (13) are carried on a respective upper and lower frame member by respective magazines (18, 19) each positionable thereby at said first punching station (A) and a single tooling set comprised of a punch assembly (12) and a die assembly (14) is fixed at said second punching station (B) each also mounted on a respective one of said frame members, said second punching station thereby located within said punch press frame spaced from said first punching station.

8. The punch press according to claim 7 further including a power cylinder (15) comprising said punch driving means operating said single tooling set (12, 14) at said second punching station (B).

9. The punch press according to claim 7 whereby one of said punch or die assemblies (12, 14) is mounted beneath said trap door member (37) aligned with an opening (39) in said trap door (37), and further including elevator means (22) for raising and lowering said punch or die assembly (12, 14) through said opening (39) to allow support of said punch or die assembly (12, 14) below said trap door (37) while accommodating lowering of said trap door member (37).

* * * * *